US006244943B1

(12) United States Patent
Böhler et al.

(10) Patent No.: US 6,244,943 B1
(45) Date of Patent: Jun. 12, 2001

(54) SURFACE-PROCESSING APPARATUS

(75) Inventors: Günther Böhler; Daniel Böhler, both of Denzlingen (DE)

(73) Assignee: Guther Bohler GmbH, Denzlingen (DE)

( * ) Notice: Subject to any disclaimer, the term of this patent is extended or adjusted under 35 U.S.C. 154(b) by 0 days.

(21) Appl. No.: 09/223,017

(22) Filed: Dec. 30, 1998

(51) Int. Cl.[7] ..... B24B 5/00
(52) U.S. Cl. ..... 451/294; 72/359; 72/342
(58) Field of Search ..... 451/353, 359, 451/259, 294, 360, 342

(56) References Cited

U.S. PATENT DOCUMENTS

| | | | | |
|---|---|---|---|---|
| 2,950,583 | * | 8/1960 | Nilsson | 451/353 |
| 2,993,311 | * | 7/1961 | West | 451/359 |
| 5,679,066 | * | 10/1997 | Butz et al. | 451/359 |
| 5,718,621 | * | 2/1998 | Turley | 451/359 |

* cited by examiner

*Primary Examiner*—Rodney Butler
(74) *Attorney, Agent, or Firm*—Breiner & Breiner

(57) ABSTRACT

An apparatus to process, in particular, curved surfaces using one or more grinding or polishing tools which includes a housing (2) having a drive system (3, 20, 19, 12) powering at least one tool seat (1) particularly for a grinding or polishing tool (W) into rotation about a longitudinal axis (4). For the purpose of multi-sided pivoting displacement of the axis of rotation (4) within a predetermined angular range (α), the tool seat (1) rests pivotably in a holder (5) of the housing (2), the holder (5) including a shell (7) having an outer contour in the shape of a spherical segment and being pivotably received in an inner contour of a seat (8) also in the shape of a spherical segment. The drive system (3, 20, 19, 12) includes a pivoting ball-joint (6) coupling it to the tool seat (1) in order to drive the seat into rotation in every pivoted position. To reliably eliminate operational vibrations, the pivoting articulations are configured in such a manner that the center (C) of the pivoting motion of the shell (7) in the seat (8) coincides with the center of pivoting (G) of the ball-joint (6). While this apparatus only requires modest manual operator skills, it makes it possible nevertheless to process in a simple manner, in particular concave or convex surfaces, in particular using a grinding or polishing tool.

21 Claims, 5 Drawing Sheets

Figure 1:
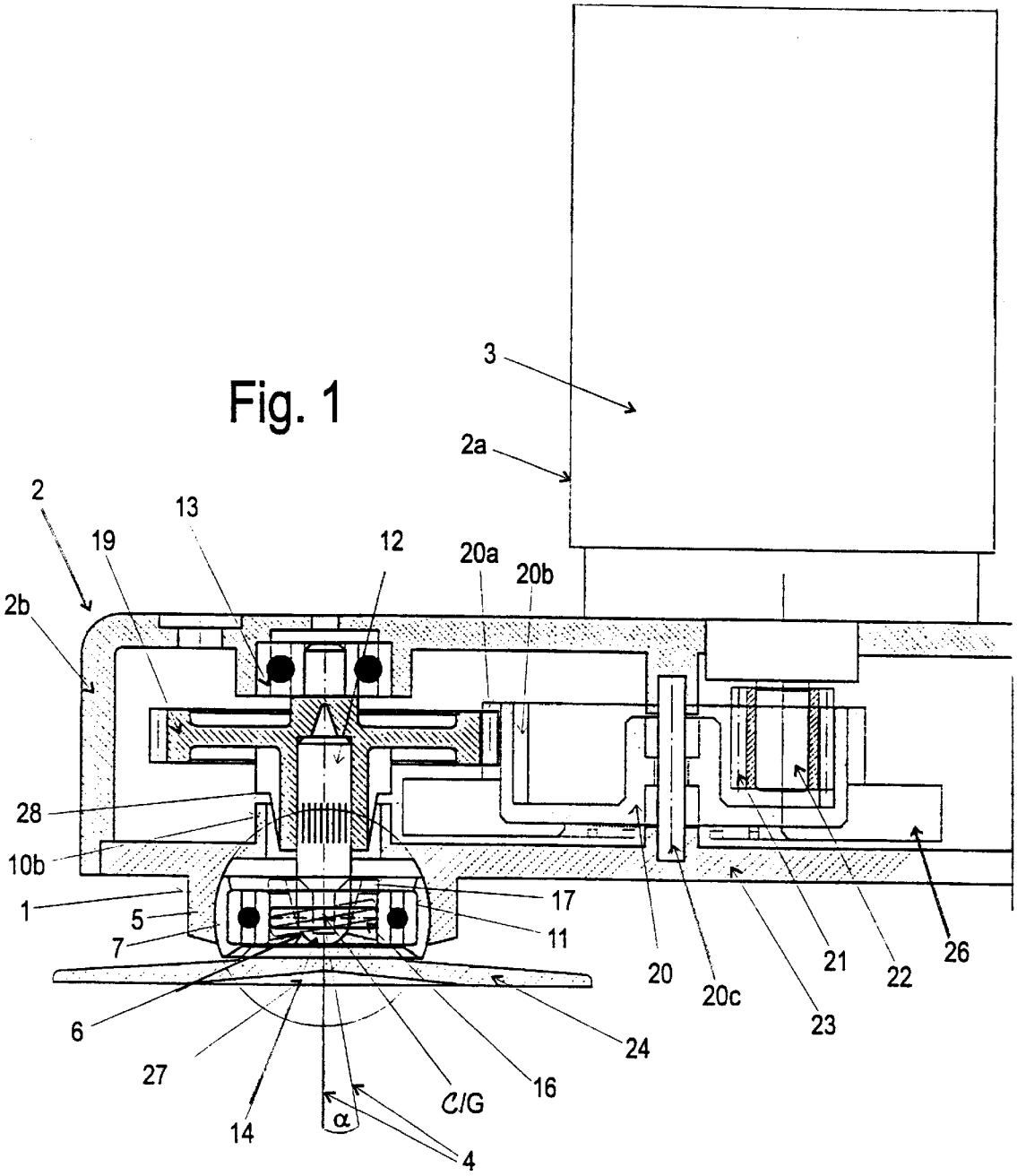

Fig. 4c
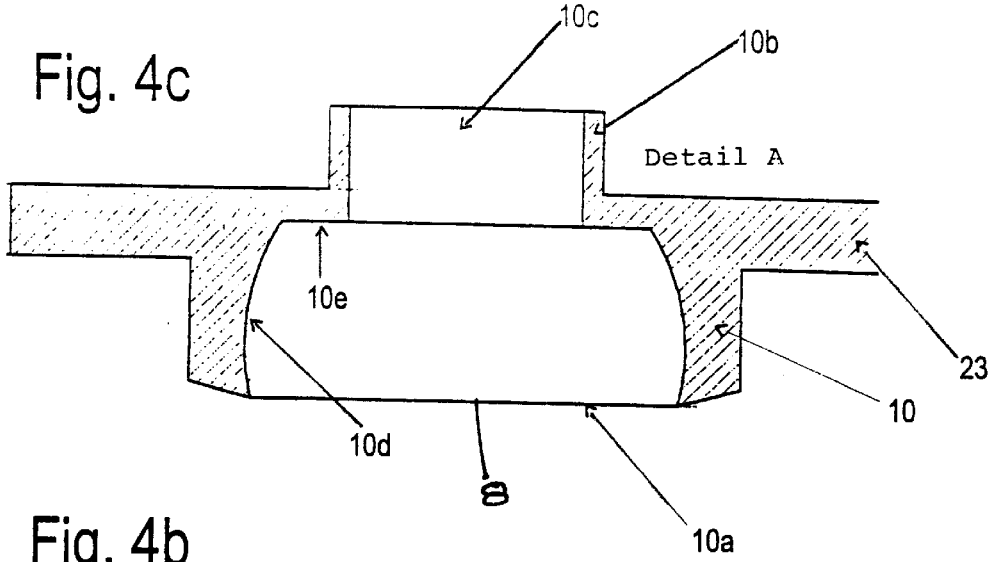
Fig. 4b
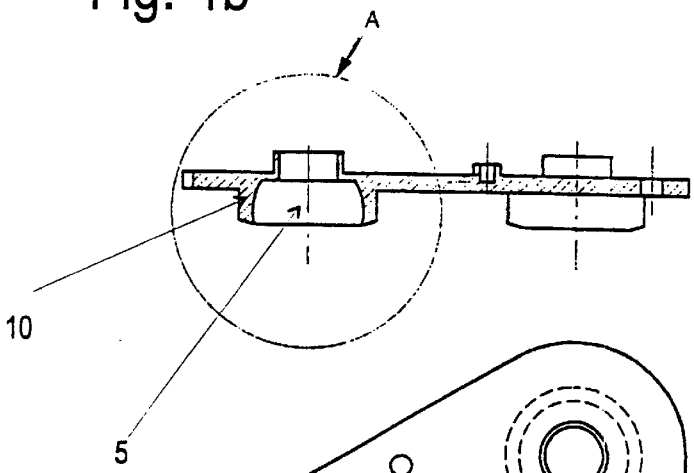
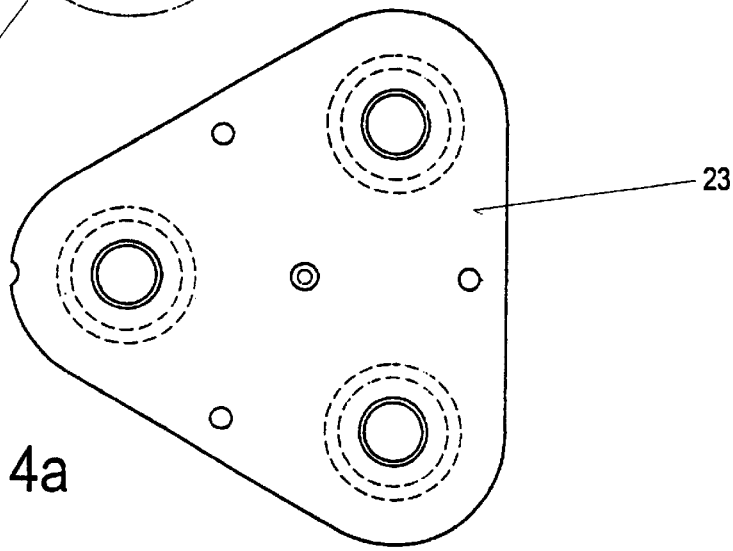
Fig. 4a

Fig. 6c
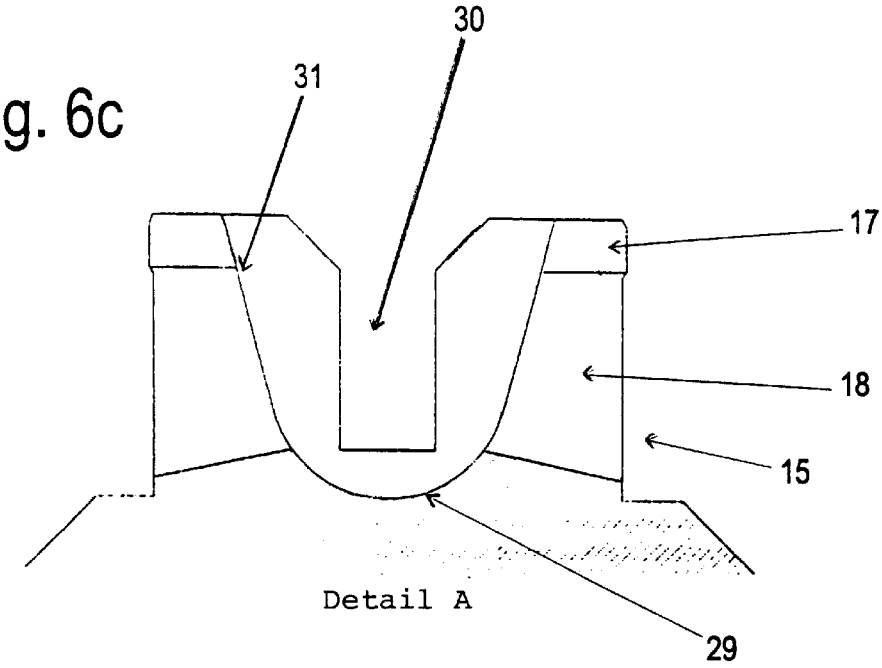
Fig. 6b
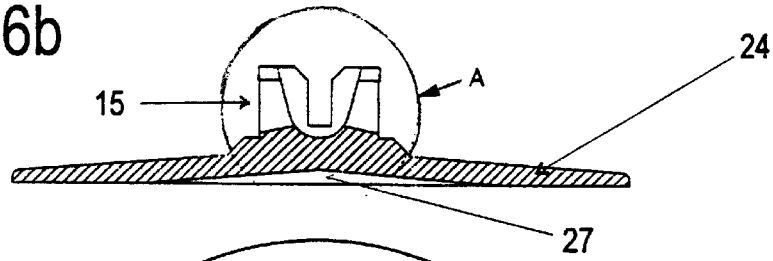
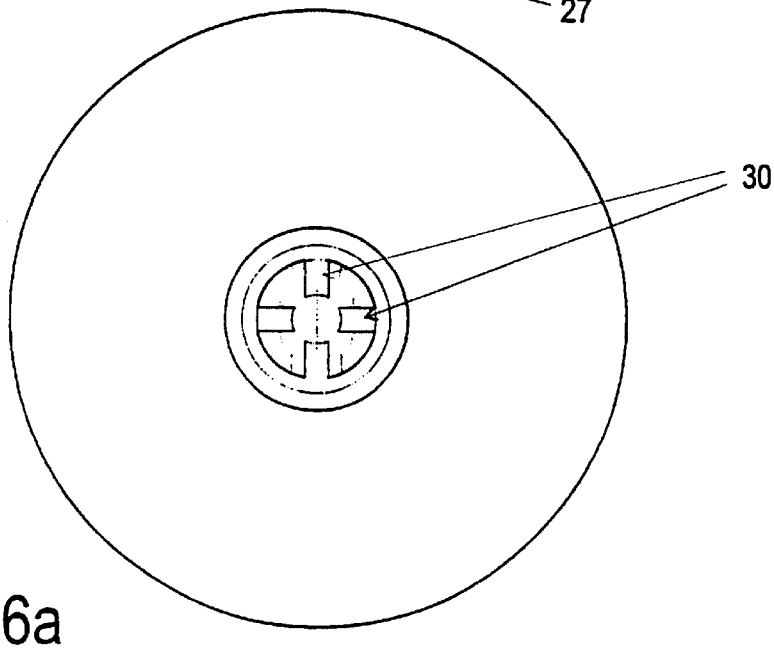
Fig. 6a

SURFACE-PROCESSING APPARATUS

The present invention relates to apparatus for processing, in particular, curved surfaces, including a grinding or polishing tool, fitted with a housing, and a drive system to power at least one tool and to rotate it about its longitudinal axis.

Apparatus to process surfaces using a powered grinding or polishing tool are comprehensively known by a number of designs. Illustratively, right-angle grinders, orbital/vibrating grinders, or eccentric grinders, are commercially available. The right angle grinders include a plate rigidly supported in a housing and acting as a support for a grinding or polishing disk, this plate being driven about its longitudinal shaft running at 90° to that of the motor. On the other hand, as regards vibrating/orbital and eccentric grinders, the grinding disk is not directly rotated by the motor about its longitudinal shaft, but is made to vibrate by the insertion of a cam.

The heretofore known designs incur the drawback that, when processing curved surfaces, the particular work topology is restricted to a small zone, and that the engaging or applied surface of the grinding tool is determined by the operator solely by the position in which the latter holds the apparatus. As a result, and especially when processing curved surfaces, constant manual follow-up and monitoring of the holding, i.e., engaging position of the grinding tool, and of the applied pressure on the surface being processed will be required because the known apparatus not only demands substantial operator experience and skill to keep the tool steady, but furthermore curved surfaces cannot be processed satisfactorily, evenly and effectively, at all or only partially.

An objective of the present invention is to improve to such an extent surface processing apparatus including at least one tool support, in particular, for a grinding or polishing tool such that the processing of curved surfaces is simplified, and the demands of operator experience and skill relating to apparatus handling is reduced.

In a particular embodiment of the apparatus of the invention, its operation is especially quiet and vibration-free and the tool(s), upon wear, are easily replaced.

This problem is solved by the invention by creating surface processing apparatus including: a housing with a drive system which powers a tool seat to rotate, in particular a grinding or polishing tool, about its longitudinal shaft, the seat resting in a holder in the housing, for the purpose of omnidirectional pivoting of the axis of rotation within a predetermined angular range $\alpha$. This affixation means includes a shell having an outer contour in the form of a spherical segment and which is pivotably received in an inner contour which is in the shape of a spherical segment. The drive system is fitted with a pivotable ball-joint to couple the drive system to the tool seat in order to power the tool seat into rotation in any pivoted position, the center C of the shell's pivoting motion in the seat coinciding with the center of pivoting motion G of the ball-joint.

An especially preferred embodiment of the invention relates to surface processing apparatus, in particular for curved surfaces, which includes a housing fitted with a drive system powering several tool seats, in particular for grinding or polishing tools, to rotate them about their particular longitudinal axes. Each tool seat is pivotably supported to allow multi-sided pivoting of the axis of rotation within a given angular range $\alpha$ in a holder of the housing; the holder includes a shell having an outer contour in the shape of a spherical segment pivotably received in a seat having an inner contour in the shape of a spherical segment. The drive system includes a pivotable ball-joint associated with each tool seat to couple the drive system to the particular tool seat in order to power the latter into rotation into each pivoted position. The center C of the pivoting motion of the particular shell in the seat coincides with the center of pivoting motion G of the particular associated ball-joint. In this design, preferably three tool seats are configured in a triangular manner at the end face of the housing.

Figure 2:
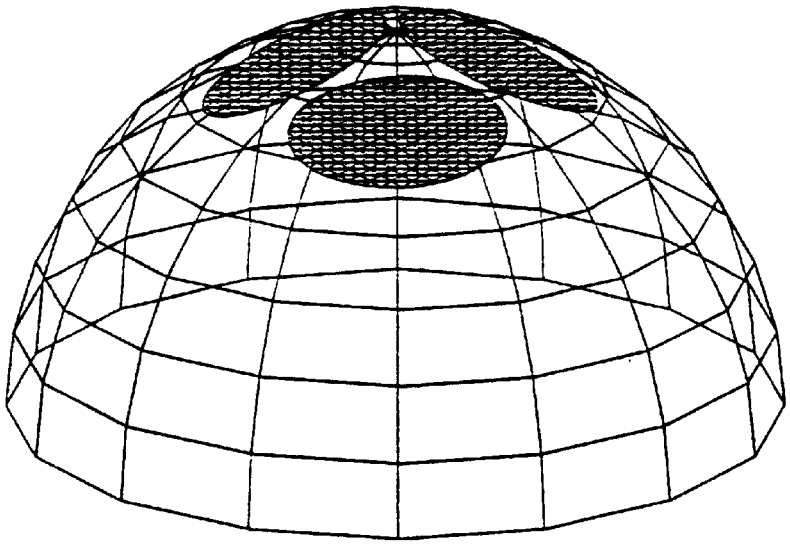

The surface processing apparatus of the invention offers the advantage that a tool supported in a multi-sided, pivotable manner in a tool seat remains engaged by the operator within the given angular range, independently of the position in which the operator holds the apparatus, i.e., the housing, in that it will be applied with the maximum applied rest area on the surface being processed. This feature holds both for convex and concave surfaces (FIG. 2). As a result, the need for operator manual skills when processing surface contours is substantially reduced. Moreover, the apparatus' operating zone is increased. For example, if the apparatus were held in a pivoted position and accessibility of a surface to be processed were thereby restricted, the tool still would be engaged, i.e., applied. Because of the coincidence of the center C of the pivoting motion of the tool seat and the center of pivoting motion G of the associated ball-joint, vibrations are avoided in any operation at any pivoted position of the tool.

In regard to the preferred embodiment of the three tools supported in a multi-sided pivotable manner, the triple-point application provides a simultaneously further enlarged processing area and uniform spreading of compressions on the surface being processed.

Further embodiments of the invention fit the tool seat with a radial bearing inserted into the shell to rotate the seat about its longitudinal axis. The ball-joint includes a shaft rotatably supported in the housing and assuming a spherical shape at an axial end exiting from the housing in an area of the tool seat, this spherical end being inserted or insertable into a spherical recess of an adapter. The adapter is coupled or can be coupled by frictional locking means or by geometrical interlocking connectors on one hand to the shaft and on the other hand to the tool seat.

This design offers the advantage of exchangeability, for example, between a disk-shaped tool affixation means for a grinding disk or the like and the tool seat. This allows replacing worn tools in a simple manner without resorting to special means.

A preferred embodiment of the invention is illustrated below in relation to the drawing.

Figure 3:
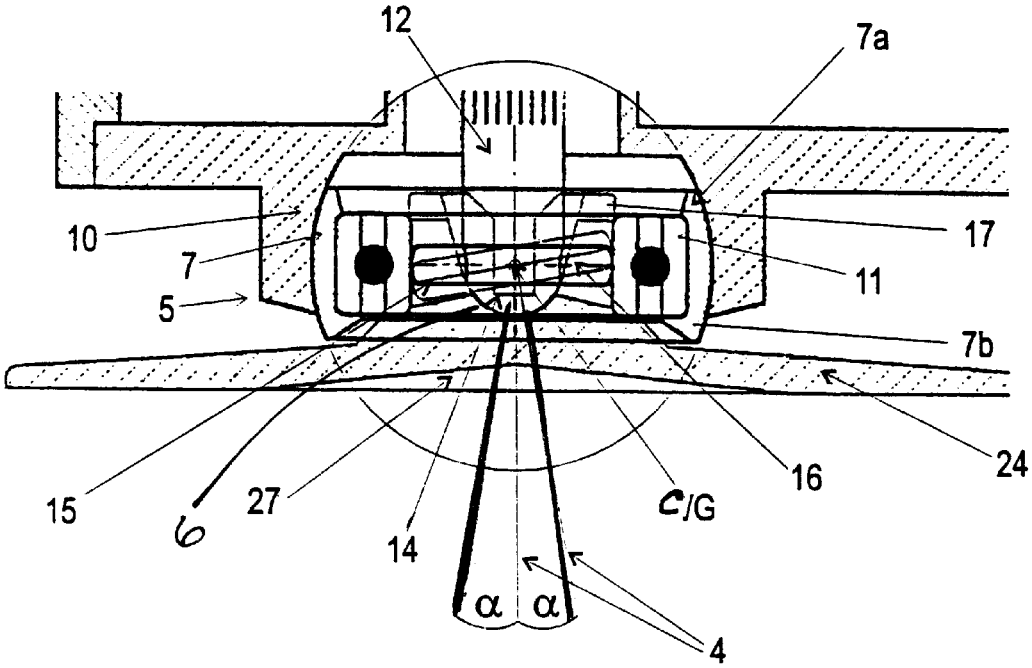
Figure 5B:
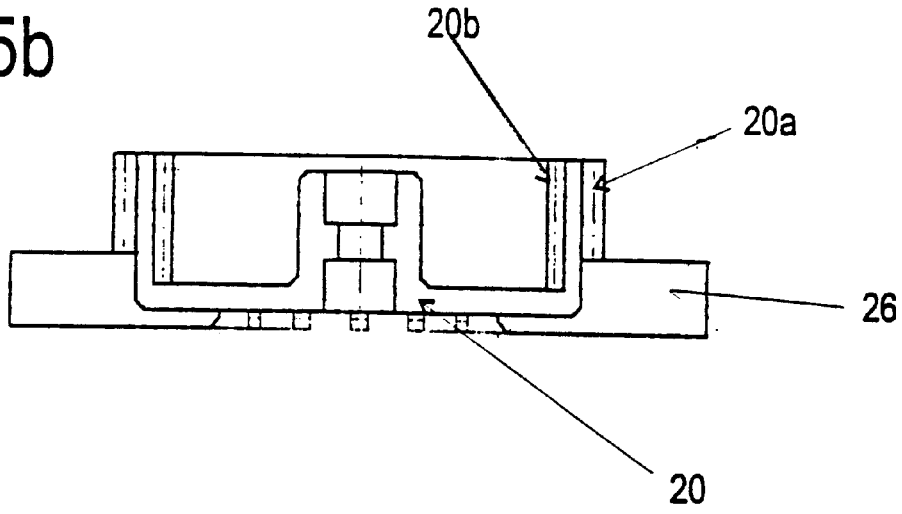
Figure 5A:
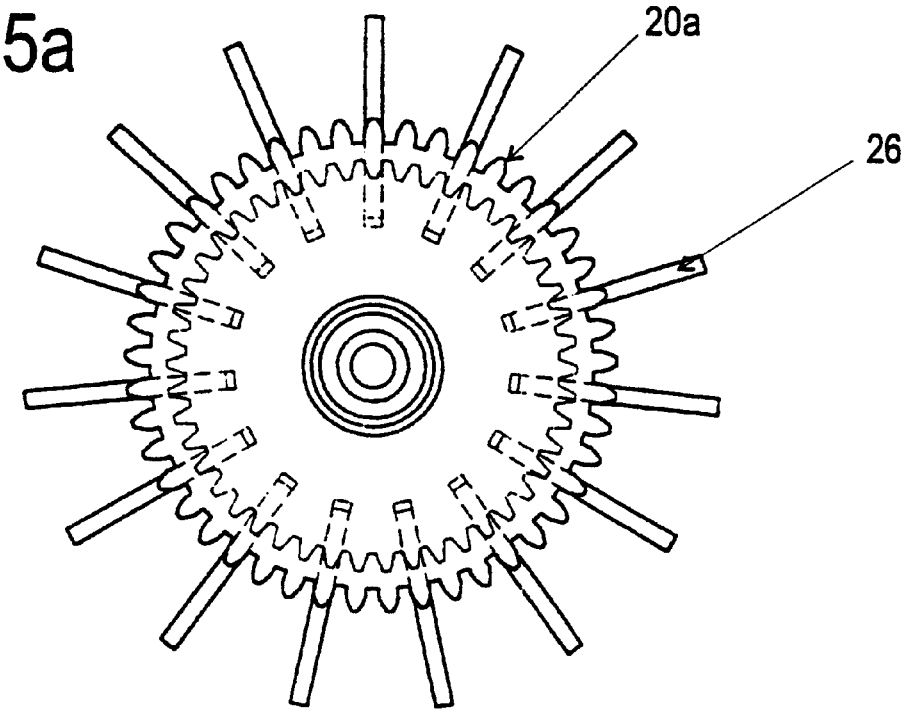

FIG. 1 is a partial sectional side view of a surface-processing apparatus fitted with three tools, FIG. 2 is a schematic view of the work zone of the apparatus of FIG. 1 on a curved surface, FIG. 3 is an enlarged view of the tool seat of the apparatus of FIG. 1, FIGS. 4*a,* 4*b,* 4*c* are respectively a top view of the housing base at the front side of the apparatus of FIG. 1, a sectional side view of the housing base of FIG. 4*a,* and an enlarged detail A of a recess for a pivotable tool seat;

FIGS. 5*a,* 5*b* respectively are a top view of the central gear of the drive system of the apparatus of FIG. 1 and a sectional side view of the gear, and FIGS. 6*a,* 6*b,* 6*c* respectively are a top view of a grinding disk for the apparatus of FIG. 1, a sectional side view of the grinding disk, and an enlarged detail A of the adapter between the grinding disk and the tool seat.

The following detailed description of a preferred embodiment of the invention is restricted to a surface-processing apparatus fitted with three tool seats 1 in a triangular configuration at an end face of the housing 2. As shown by FIG. 4, the tools are mounted approximately equi-angularly at the corners of an equilateral triangle.

The individual tool supports are of the same design, and only the design of one support is described below. However, the embodiments of the invention are directly applicable also to a single tool, to one fitted with three tools (as above), or with a number of tools matching the above embodiment.

The housing 2 includes an upper housing portion 2*a* which receives a drive system 3, for example an electric motor, and a lower housing portion 2*b* which receives a gear box and holders 5 for each of one or more tool seats 1. The housing portions are joined integrally or connected to each other appropriately, for example, by screws, clips or bonding The lower housing portion 2*b* is closed by a base plate 23 at the end face of the apparatus. This plate 23 is connected by a screw or by a detent connection (not shown) or the like to the housing portion 2*b*. The housing portions and the base plate preferably are of a plastic having desired properties (impact strength, thermal/cold and acid resistances, surface quality, etc.). Alternatively, several or all parts can be made of metal or rubber.

The tool seats 1 for the exchangeably affixed tools W can each be driven into rotation about their longitudinal axes 4 and rest pivotably in a holder 5 of the lower housing portion 2*b*. By means of this bearing, the axis of rotation 4 can be pivoted on all sides about the longitudinal axis determined by the tool seat being in a straight position, in particular within an angular range $\alpha$ determined by the bearing design. As a result, the range of motion of the axis of rotation is within a cone with an angle of aperture $2\alpha$.

As shown in FIG. 1, the holder 5 includes a spherical shell 7 having an outer contour in the form of a spherical segment and which is pivotably received in a recess 8 present in the base plate 23. The recess 8 is fitted with an annular stub 10 integral with the base plate and projecting from the housing outside, the shell 7 being inserted from the side of the base plate 23 facing the outside of the housing 2 into the stub 10. As shown in FIG. 4*c*, the inside dimensions of the stub 10 and its inner contour 10*d* are selected in such a manner as to substantially correspond to the curvature and size of the outer contour of the shell 7 while offering a suitable fit or play as required for motion. Accordingly, the stub 10 includes a spherical inner contour 10*d*, i.e., a spherical segment, in order that the shell 7 is pivotably guided and constrained in the stub 10. The inner contour of the stub 10 tapers to an extent towards the outside so that an aperture 10*a* remains which has a diameter which is less than the greatest diameter of the shell 7. Because of the resiliency of the edges of the stub 10, shell 7 can be forced during assembly into this stub and, because of the undercut in the stub, is then held in the area of the aperture 10*a* to prevent it from dropping out at the front side, i.e., out of the housing.

The inner contour of the stub 10 continues toward the housing inside by a base 10*e* which bounds the pivoting motion of the shell, and by an adjoining cylindrical annular projection 10*b* which points toward the inside and encloses a passage 10*c* in the base plate for a drive shaft 12.

Alternatively, the recess 8 acting as a bearing for the pivotable shell also can include several parts or be a separate part joined, for example, by force-fitting, bonding, screw-connection or affixation means to the base plate.

Preferably, the spherical shell 7 and the stub 10 are matched materials of low friction. Preferably, they are made of appropriate plastics. Further, the self-lubricating properties, for example, of materials such as brass, bronze etc., can be used for the shell and/or the stub, or for coating the contact surfaces. Where required, the relative displacements of stub and shell can be additionally eased using a lubricant.

A bearing, preferably a roller bearing 11, is inserted into and affixed to the spherical shell 7. In the embodiment shown in FIGS. 1 and 3, the outer race of the roller bearing 11 is held by two radial offsets 7*a* and 7*b*. Alternatively, the bearing can be held in place by an offset or a securing ring, by two securing rings, or by force-fitting or bonding the outer race. The bearing 11 supports the tool seat 1 and the tool holder or tool therein to allow for rotation of the latter about the longitudinal axis 4. In regard to the coupling action using an adapter 15 (further described below) to couple or detachably couple the tool holder or the tool with the inner race of the bearing 11, the above described tool seat 1 assures the simultaneous tool rotation about its longitudinal axis 4 and pivoting motion of the axis of rotation to all sides within a given angular range about a center C by resting the shell 7 in the holder 5.

The apparatus of the invention furthermore includes a drive system to set the tool seat 1 into rotation about the longitudinal axis 4 to reach the particular pivoted position. For that purpose, the drive system of each tool seat is fitted with a pivotable ball-joint 6 coupling the drive system and the tool seat 1 to transmit the rotation, i.e., the torque, of a motor 3 acting as a drive from its output shaft in each pivoted position, to the tool seat, i.e., to its tool.

This ball-joint 6 is presently described in further detail in relation to FIGS. 1 and 3. The ball-joint 6 includes a shaft 12 which, at one end, rests adjacent a bearing 13 in the housing 2, and which, at its other end, passes through the cylindrical annular projection 10*b* and the passage 10*c* through the base plate 23, thus allowing rotation. Furthermore, the ball joint is spherical at the axial end 14 issuing out of the housing 2 in the region of the tool seat 1. In a single tool embodiment of the apparatus of the invention, the spherically tipped shaft can be connected directly, that is without such a bearing in the housing, to the output shaft of a drive system 3.

The spherical end 14 of the shaft 12 is inserted or insertable into a spherical recess 29 of the adapter 15. The distinction between "inserted" and "insertable" is made in relation to the adapter 15 because it can be either an integral part of, or a separate but subsequently connected part of, a tool support 24 as described below, and therefore it can be jointly exchangeable with this support or it can be part of the apparatus, i.e, of the tool seat 1 itself, in which case a tool support or tool must be detachably affixed to the adapter. In the embodiment shown, the adapter 15 is part of a disk-shaped tool support 24. At its side facing the base plate 23 of the housing 2, the adapter 15 includes the spherical recess 29 receiving the shaft 12 at the correspondingly shaped spherical end 14. This ball-joint coupling allows for a free spatial pivoting motion of the adapter relative to the shaft 12 about the pivoting center G in harmony with the pivoting motion of the tool seat in the holder 5 in the housing about the center of pivoting C. It is very important in the invention that the center of pivoting G of the ball-joint between the shaft and the adapter precisely coincide with the pivoting center C of the tool seat to preclude operational vibrations.

Torque transmission from the shaft 12 to the adapter 15, i.e., to the tool seat 1, is implemented by frictionally locking and/or geometrically interlocking the shaft 12 and the adapter 15, and by the simultaneous ability of having ball-joint pivoting motion.

In the embodiment shown (FIGS. 1, 3 and 6*a*–6*c*), the adapter 15 is an annular projection 18 integral with a disk-shaped tool support 24 which encloses a spherical recess 29. The spherical recess 29 flares conically to the edge of the projection to allow the adapter to tip or pivot at the spherical end 14 of the shaft 12. The size and contour of the flaring portion depend on the required pivoting range. A radial offset 17 is present at the outer periphery of the annular projection 18 and allows for coupling of the adapter in a detachable and detent manner with the inner race of the radial bearing 11. Slots or channels 30 are configured transversely to the spherical recess 29 at the outer periphery and receive a pin-shaped projection 16 present at the spherical end 14 of the shaft 12. This pin 16 is inserted through a borehole running across the sphere at the end of the shaft 12 and projects from both sides of the sphere and is able to move in the slot 30 during the pivoting motion. Once the adapter has been set on the shaft end and is coupled in a detent manner with the inner race of the radial bearing 11, an angular balancing connection is set up between the shaft 12 and the tool seat 1. As a result, the tool seat 1 will be driven, in the case of rotating shaft 12, to rotate about the longitudinal axis 4 of this shaft 12 in every spatial pivoting position.

Alternatively, the force transmission between shaft and adapter can be implemented in that the spherical shaft end is fitted with several edges or protrusions at the spherical surface to engage clearances present in the spherical inside contour of the passage and to preserve this engagement in each pivoted position.

Alternative to, or in combination with, the conical flaring of the recess 29 toward the edge of the protrusion, the shaft 12 can taper in the area adjoining the spherical end in order to assure free pivoting motion of the adapter within the predetermined angular range without colliding with the shaft.

In regard to the described embodiment of the three tool seats or tools, the individual ball-joints 6 can be driven jointly into rotation by the drive system 3. For that purpose, the shafts 12 are ganged together by a force transmission unit or a gear box. Preferably, the gear box is a planetary gear system for each of which an externally toothed planetary wheel 19 is irrotationally connected to each shaft 12. In the embodiment shown, the particular shaft 12 is force fitted into an axial borehole of the planetary wheel. The planetary wheels 19 engage a pot-shaped central wheel 20 fitted with external teeth 20*a* which in turn can be driven by a pinion 21 on the output shaft 22 of the motor 3 engaging inside teeth 20*b* formed at the inside circumference of the pot-shaped gear 20. The pot-shaped gear 20 is rotatably supported in the housing on a shaft 20*c*. By selecting the number, configuration, and size of the gears, the desired up/down gearing can be achieved to impart the required torque and direction of rotation to the tools.

To improve motor cooling, a fan wheel 26 is fitted to the central gear 20 of FIGS. 1 and 5. The fan blades can be integral with the pot-shaped gear 20, or they can be a separate component and be connected to this gear. Air exhausts (not shown) are present in the housing 2 in its lower portion 2*b* through which the air aspirated by the air intake apertures in the upper housing portion 2*a* can be made to circulate through ducts (not shown) which cool the motor 3 when the fan wheel rotates during apparatus operation. Alternatively or additionally, other gears of the gear box can also be fitted with a fan wheel.

In the embodiment shown of the invention, the projections 10*c* point toward the inside of the housing and are mounted on the housing base plate in the region of the passages for the shafts 12 of the ball-joint 6 and are used to keep the gears fitted with the corresponding mating surfaces 28 (planetary wheels or gears or friction wheels) of the force transmission unit or gear box together with the shafts in the particular engaged position during assembly. As a result, both apparatus assembly and any subsequent repairs are significantly simplified. At the same time, he protrusions of the base plate together with the gear/wheel mating surfaces are used to limit the range of shaft motion during operation.

In the embodiment shown, the adapter 15 is integral with the tool support. However, the adapter can be a separate component connected to the tool support or, as described, it can be a part of the tool seat in the apparatus. In that case, the tool seat can be coupled, for example by a screw or latch, with the adapter of the tool seat. As a result, the tool support can be mounted on or dismantled from the apparatus in a simple manner for purposes of exchange. The embodiment shown, wherein the adapter is a part of the tool support and can be inserted in a detenting and detachable manner into the tool seat, furthermore offers the advantage of tool changes being possible without assembly accessories such as screwdrivers or sockets.

The shown tool support with the disk-shaped flaring is preferably suitable for grinding tools. It constitutes a work surface at the side bearing the tool. The size of the disk-shaped flaring depends on the desired work surface and on the distance(s) between the tools. A clearance 27 is located at the center of the disk-shaped flaring. This clearance 27 enlarges the effective tool work surface, especially in regard to grinding or polishing lamina mounted on the tool support which prevents the work surface from resting only at the center point when processing a curved surface. For easier exchangeability, the grinding or polishing lamina is detachably mounted to the shell-shaped tool support. Bonding or Velcro connection can be used for this purpose. Bearing in mind that the grinding or polishing laminas to be mounted on the tool support also have a clearance or recess at the center zone to avert point contact in this zone.

Alternatively, the tool support or the tool seat can be in the form of a polishing tool or a brush.

Many variations are possible with respect to the described embodiment. Illustratively, the central, pot-shaped gear 20 of the gear box 18 can be replaced by an outer-toothed gear, the drive system pinion 21 also then engages the outer teeth. The central, pot-shaped gear 20 can be replaced by a toothed or frictional belt or a chain running around the planet wheels, all driven by the drive system. The planet wheels are in the form of gears, wherein the central gear or the pinion can be replaced by frictional wheels provided that the frictional torque transmission is adequate. If further up/down gearing is required, an additional gear box can be inserted between the drive system and the gear box.

As an alternative to the described ball-joint, the linkage between the tool and the drive system can also be implemented as a universal joint or another articulating joint. In particular, a cardan joint can be used provided it allows torque transmission with simultaneous angular adjustability between the driving and the driven sides. To avoid vibrations, the centers of gravity of the particular articulating joints must coincide with the center of pivoting of the particular tool seat.

The drive system can be, as described above, an electric motor, though it also can be a pneumatic motor, a motor operating on another principle, or it can be a central drive means outside of the apparatus which transmits rotation by a flexible shaft or the like to the apparatus.

Furthermore, it is conceivable that the apparatus of the invention, having the supported tool so as to be pivotable on all sides, and in particular the apparatus holding only one tool, can be designed not only as a grinding or polishing apparatus, but the grinding or polishing lamina can be replaced with a correspondingly adapted tool mount. Also, it can be made into a screw driving means or a drill. This feature also offers the advantage of versatile handling, i.e., of many ways of holding the apparatus at different work angles while the apparatus remains engaged.

What is claimed is:

1. Apparatus for processing surfaces, comprising:

a housing, a tool seat, and a drive system for powering the tool seat into rotation about a longitudinal axis, wherein the tool seat rests pivotably in a holder in the housing so as to allow pivotal displacement in all directions within a predetermined angular range, the holder comprising a shell having an outer contour with a spherical segment, said shell being pivotably received in a recess having an inside contour with a spherical segment, the drive system comprising a pivotable ball-joint which couples the drive system to the tool seat in order to rotate the tool seat in any pivotal direction, wherein a center of pivoting motion of the shell in the recess coincides with a center of pivoting of the ball-joint.

2. Apparatus as claimed in claim 1 wherein the recess comprises a stub having a diameter less than a greatest diameter of the shell to prevent the shell from dropping out of the recess.

3. Apparatus as claimed in claim 1 or 2 wherein the tool seat has a radial bearing set in the shell to allow rotation of the tool seat along the longitudinal axis.

4. Apparatus as claimed in claim 1 wherein the ball-joint comprises a shaft which is rotatably supported in the housing and which has an axial end projecting from the housing into an area of the tool seat, said axial end being approximately spherical so as to be inserted or insertable into a spherical recess of an adapter.

5. Apparatus as claimed in claim 4 wherein the adapter is coupled or couplable by geometrical interlocking or frictional coupling to the shaft and to the tool seat.

6. Apparatus as claimed in claim 5 wherein the adapter is shaped to join an annular protrusion of the adapter integrally with or as a separate component to a tool support, the annular protrusion at least partially enclosing the spherical recess, and the spherical recess conically flaring toward an outer edge of the annular protrusion, a radial offset being integrated into an outer circumference of the annular protrusion and affixed in a detachable and detenting manner by the adapter to an inside ring of a radial bearing, channels being distributed along the outer circumference to couple the adapter to projections present at the axial end of the shaft.

7. Apparatus as claimed in claim 6 wherein a tool for use with the tool seat comprises a grinding or polishing lamina which is detachably fastened to the tool support.

8. Apparatus as claimed in claim 7 wherein the tool support is disk-shaped.

9. Apparatus for processing surfaces, comprising:

a housing for receiving and rotating tools about each tool's longitudinal axis, a plurality of tool seats, and a drive system for powering the plurality of tool seats, each tool seat resting pivotably in a holder in the housing so as to pivot to all sides within a predetermined angular range, the holder comprising a shell having an outer contour with a spherical segment, said shell being pivotably received in a recess having an inner contour with a spherical segment, wherein the drive system comprises a pivotable ball-joint associated with each tool seat and which allows coupling of the drive system to an associated tool seat in order to power the tool seat into rotation, a center of pivoting motion of the shell in the recess coinciding with a center of pivoting motion of an associated ball-joint.

10. Apparatus as claimed in claim 9 wherein said plurality of tool seats are three tool seats which are in a triangular configuration on one side of the housing.

11. Apparatus as claimed in claim 9 or 10 wherein each recess comprises a stub having a diameter less than a greatest diameter of the shell to prevent the shell from dropping out of the recess.

12. Apparatus as claimed in claim 9 or 10 wherein each tool seat comprises a radial bearing to rotate the tool seat about the longitudinal axis, the radial bearing being inserted into the shell.

13. Apparatus as claimed in claim 9 or 10 wherein each ball-joint comprises a shaft rotatably resting in the housing and having a spherical axial end which issues from the housing in an area of an associated tool seat, this axial end being inserted or insertable into a spherical recess of an adapter.

14. Apparatus as claimed in claim 9 wherein the drive system includes a drive unit and a force transmission unit or a gear box to jointly drive the shaft of each ball-joint.

15. Apparatus as claimed in claim 9 further comprising projections which point inward of the housing and are present in an area of the shafts of the ball-joints and wherein planetary wheels or gears or friction wheels for the shafts are positioned for alignment on the projections.

16. Apparatus as claimed in claim 13 wherein the adapter is coupled or couplable by geometric interlocking or frictional connection means to the shaft and the tool seat.

17. Apparatus as claimed in claim 16 wherein the adapter is an annular protrusion associated with a disk-shaped tool support, said annular protrusion including a projection which encloses the spherical recess and which flares conically toward an edge of the projection, a radial offset being integrated into an outer circumference of the annular protrusion to allow coupling in a detachable and detenting manner of the adapter to an inner race of the radial bearing, and wherein channels are distributed along the outer circumference to allow coupling of the adapter to projections at the axial end of the shaft.

18. Apparatus as claimed in claim 17 wherein tools for use with the plurality of tool seats include grinding or polishing laminas which detachably affix to the disk-like tool supports.

19. Apparatus as claimed in claim 14 wherein the gear box includes a planetary transmission system wherein each shaft of each ball-joint is connected to a planetary wheel engaging a central gear powered by the drive system.

20. Apparatus as claimed in claim 14 wherein the force transmission unit includes a belt drive system wherein each shaft of each ball-joint is connected to gears or friction wheels which are in turn coupled to a toothed or friction belt powered by the drive system.

21. Apparatus as claimed in claim 20 wherein at least one of the gears is fitted with at least one fan wheel and the housing comprises air exhausts which expel air which is then aspirated through air intake apertures and is guided through channels to cool the drive system.

* * * * *